United States Patent [19]

Whitehorne

[11] Patent Number: 4,648,165

[45] Date of Patent: Mar. 10, 1987

[54] METAL FRAME (SPRING PULLER)

[76] Inventor: Gary R. Whitehorne, Rte. #1 Box 668, Glen Allen, Va. 23060

[21] Appl. No.: 669,881

[22] Filed: Nov. 9, 1984

[51] Int. Cl.[4] ..... B25B 27/14

[52] U.S. Cl. ..... 29/225; 29/278

[58] Field of Search ..... 29/267, 225, 278; 254/25; 81/488

[56] References Cited

U.S. PATENT DOCUMENTS

| | | | |
|---|---|---|---|
| 1,641,994 | 9/1927 | Schesvold et al. | 29/278 X |
| 1,892,824 | 1/1933 | Ziegler et al. | 29/267 X |
| 2,268,378 | 12/1941 | Berkman | 29/278 X |
| 2,441,696 | 5/1948 | Feingold | 29/267 X |
| 3,751,785 | 8/1973 | Whitesell | 29/267 |
| 3,754,314 | 8/1973 | Snorgrass | 29/278 X |

*Primary Examiner*—Frederick R. Schmidt
*Assistant Examiner*—Steven P. Schad
*Attorney, Agent, or Firm*—Gary R. Whitehorne

[57] ABSTRACT

A hand held tool for removing springs from a metal picture frame. The tool includes a bent shaft and a U-shaped paddle provided on the end thereof for engaging the spring to be pulled.

1 Claim, 1 Drawing Figure

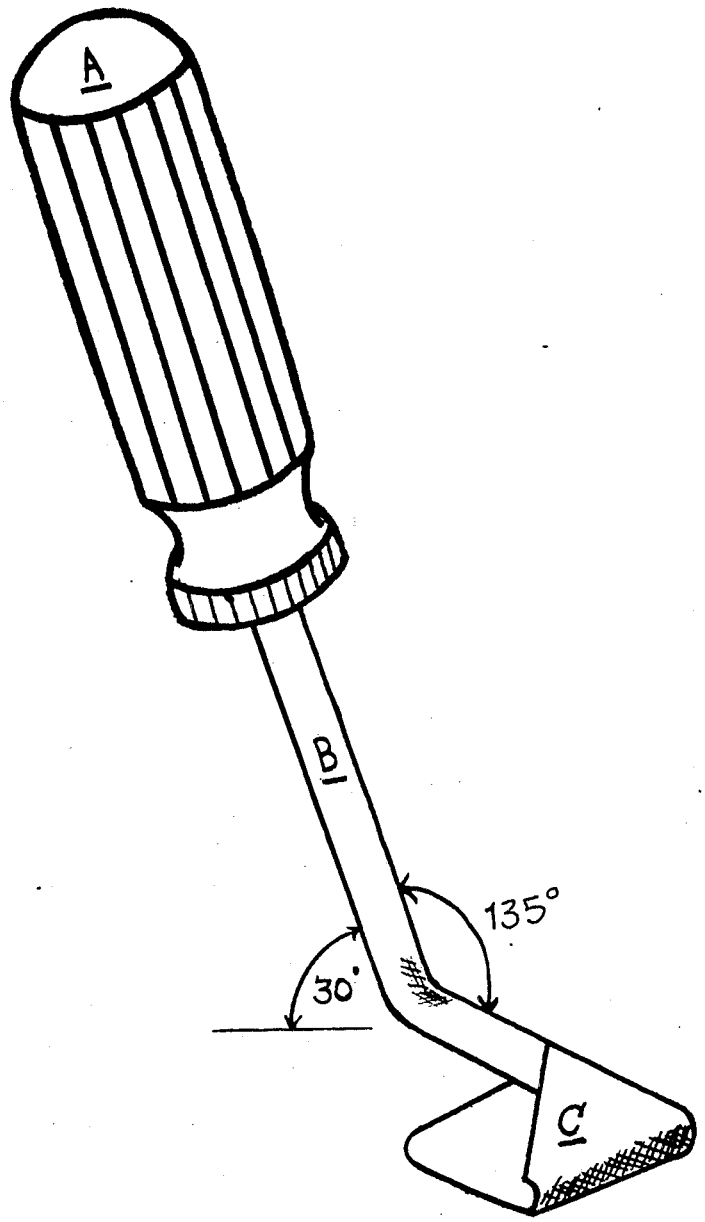
A
B
135°
30°
C

METAL FRAME (SPRING PULLER)

PURPOSE

To remove springs from the back of metal picture frames.

The spring puller is used for removing the springs in the back of metal picture frames. Spring puller is hand held (right or left hand models) and is inserted between the backing and edge of a metal frame. The angle of shaft allows user to pry with point or cup the end of spring with paddle and pull it out from between the backing and frame. The horizontal angle of the shaft allows for easy insertion, and the vertical angle allows for cupping of the spring by rocking motion if the spring have dug into the backing of the frame. A semi-pointed end of the paddle allows for hooking and or prying when cupping of the spring is not necessary for the grasping of the spring for removal. The spring puller will not only make disassembly easier and faster, but will also help eliminate glass breakage and the danger of springs which are under pressure from flying out and possibly causing eye injury to operator or by stander.

SUMMARY

The tool is used to pull springs from extruded metal moulding, particularly picture frames. The tool allows the operator to reach under the edge of the moulding and pry or hook the edge of the spring and remove it from between the backing and channel of the frame. The paddle on the end of the shaft is cupped and to a point so that the springs (which sometimes have a notch) can be pulled or pryed from under the channel.

BRIEF DESCRIPTION OF THE DRAWING

The FIGURE is a perspective view of the spring pulling tool.

DESCRIPTION

Metal Frame (Spring Puller)

A. Handle: Can be egg shaped or oblong. Plastic, wood, or any material with good griping characteristic.

B. Shaft: Metal-tempered or equivalent. Approximately $\frac{1}{8}$ inches in diameter. May be round, square, or rectangle in shape.

C. Paddle: Metal-tempered or equivalent. Approximately $\frac{1}{2} \times \frac{1}{2}$ inches, $\frac{1}{8}$ inch thick, top edge angled to form semi-point.

D. Total length of tool is approximately six inches long.

I claim:

1. A hand held tool for removing springs from a metal picture frame wherein the springs between the back and channel of the frame are used to secure works tight in said frame, said tool comprising, an elongated shaft with a bend of approximately forty-five degrees, approximately one inch from its outer most tip, a U-shaped paddle attached to the side of the shaft's outer most end wherein the base of the U-shaped paddle extends transversely approximately ninty degrees from the shaft's outer most tip and wherein the legs of the paddle are fixed to and extend parallel to the outer most end of the shaft, the paddle is further oriented so that when the legs are positioned horizontally the shaft extends upwards at approximately thirty degrees, said legs of said paddle are spaced apart so as to receive the thickness of said springs, further when the legs are in said horizontal position the upper leg is cut back to the shaft at approximately forty-five degrees which allows for encompassing and prying of the springs.

* * * * *